US006219853B1

(12) United States Patent
Johnson

(10) Patent No.: US 6,219,853 B1
(45) Date of Patent: Apr. 24, 2001

(54) TOILET VENTILATION SYSTEM

(76) Inventor: Steven W. Johnson, R.R. 1, Box 154-A, Puposky, MN (US) 56667-9741

( * ) Notice: Subject to any disclaimer, the term of this patent is extended or adjusted under 35 U.S.C. 154(b) by 0 days.

(21) Appl. No.: 09/204,428

(22) Filed: Dec. 3, 1998

(51) Int. Cl.[7] ..... E03D 9/04
(52) U.S. Cl. ..... 4/216; 4/213
(58) Field of Search ..... 4/216, 213, 218, 4/209 R, 420, 211, 214, 215, 390, 347

(56) References Cited

U.S. PATENT DOCUMENTS 1,904,898 * 4/1933 Kennedy ..... 4/378
2,190,147 * 2/1940 Ciaccio et al. ..... 4/378
2,778,033 * 1/1957 Majauskas ..... 4/213
3,192,539 * 7/1965 Martz ..... 4/213
3,681,790 * 8/1972 Dooley ..... 4/216
5,054,131 * 10/1991 Sim ..... 4/216

* cited by examiner

*Primary Examiner*—David J. Walczak
(74) *Attorney, Agent, or Firm*—Merchant & Gould P.C.

(57) ABSTRACT

A toilet ventilation system including a toilet bowl having a plurality of ports for directing water into an interior of the bowl. The toilet includes a tank for holding water, and an interior passageway for conveying water from the tank to the ports of the toilet bowl. The toilet also includes an overflow tube mounted within the tank which is in fluid communication with the interior passageway. The toilet further includes a ventilation port in fluid communication with the interior passageway. A valve structure allows water to flow from the tank to the interior passageway of the overflow tube, but prevents air from being drawn from the tank into the interior passageway through the overflow tube.

6 Claims, 3 Drawing Sheets

TOILET VENTILATION SYSTEM

FIELD OF THE INVENTION

The present invention relates generally to toilet systems. More particularly, the present invention relates to toilet systems having ventilation systems for venting unpleasant odors.

BACKGROUND OF THE INVENTION

A variety of ventilation systems have been employed to dissipate unpleasant odors present within lavatory facilities. Most commonly, ceiling fans have been used to continuously withdraw air from a lavatory facility. However, ceiling fans only ventilate unpleasant odors after they have already diffused throughout the lavatory facility. Consequently, even with operable ceiling fans, objectionable odors are still present in lavatories. Furthermore, ceiling fans are relatively inefficient because they continuously ventilate large volumes of air from the entire lavatory.

Efforts have been made to provide ventilation systems that solve the aforementioned problems associated with ceiling fans by ventilating air directly from a toilet bowl. However, such systems are commonly complicated and difficult to assemble. Furthermore, existing ventilation systems commonly cannot be readily used to retrofit existing toilet systems.

What is needed is a simple, inexpensive and easy to install ventilation system that can be used in association with new toilet facilities, and can also be used to easily retrofit existing toilet facilities. What is also needed is an efficient, quiet and inconspicuous toilet ventilation system that evacuates air directly from a toilet bowl.

SUMMARY OF THE INVENTION

The present invention relates generally to a toilet ventilation system including a toilet structure having a toilet bowl that defines a plurality of ports for directing water into an interior of the toilet bowl. The toilet structure also includes a tank for holding water, and an interior passageway for conveying water from the tank to the ports of the toilet bowl. The toilet structure further includes an overflow tube mounted in the tank that is in fluid communication with the interior passageway. The toilet structure additionally includes a ventilation port in fluid communication with the interior passageway, and a valve structure that allows water to flow from the tank into the interior passageway through the overflow tube, but prevents air from being drawn from the tank into the interior passageway through the overflow tube.

In use, a ventilation line is preferably connected to the ventilation port of the toilet ventilation system. When water is not in the interior passageway, the ventilation line can draw air from the toilet bowl through the ports of the toilet bowl. The air drawn through the ports flows through the interior passageway and exits the toilet structure through the ventilation port. The valve structure of the overflow tube prevents air from being evacuated from inside the tank. In this manner, the total amount of air evacuated by the ventilation system is minimized.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate an embodiment of the present invention and together with the description, serve to explain the principles of the invention.

A brief description of the drawings are as follows.

DETAILED DESCRIPTION

Figure 1:
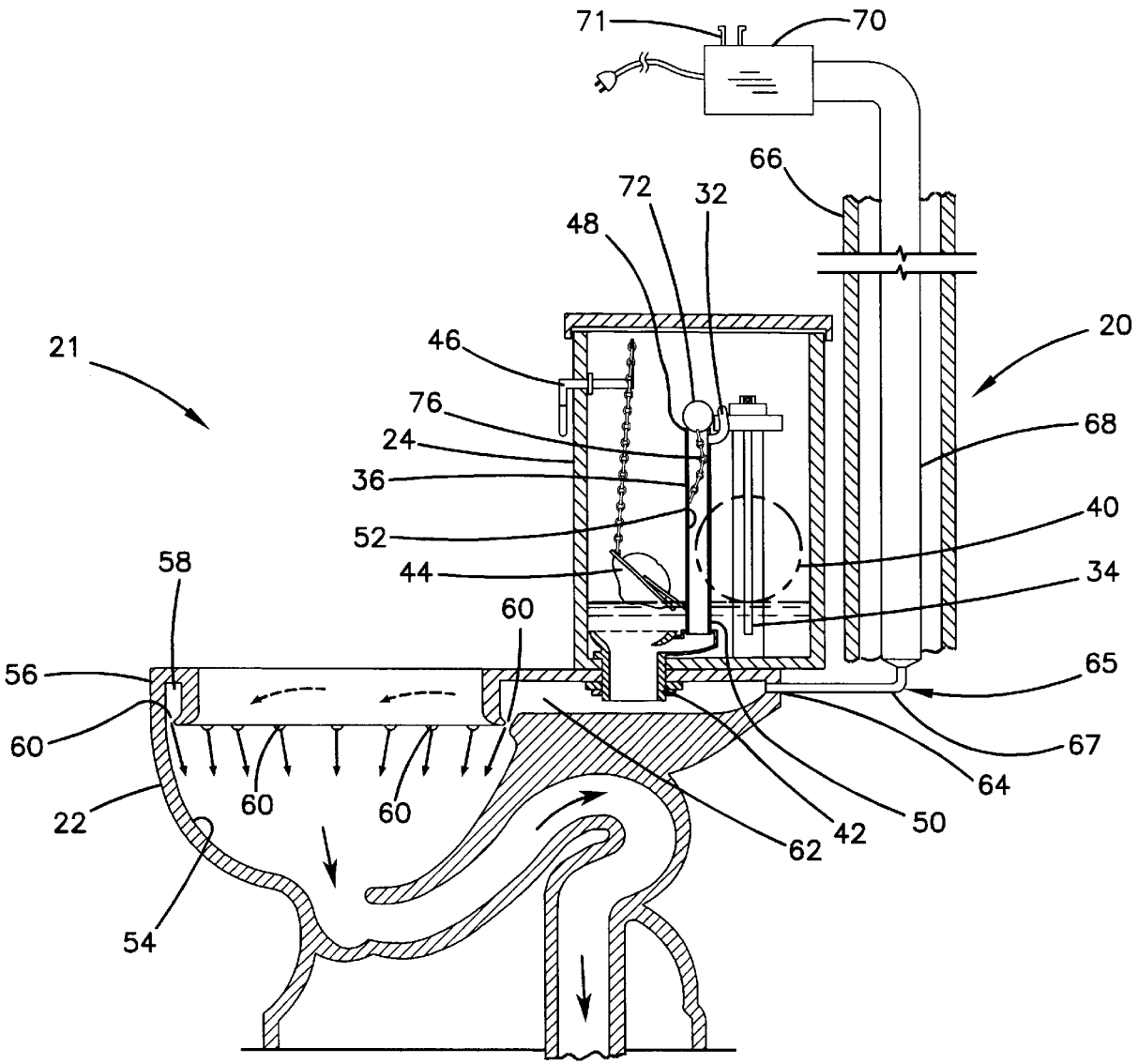
FIG. 1 is a schematic side cross-sectional view of an exemplary toilet equipped with a toilet ventilation system that is an embodiment of the present invention, the toilet is shown in the process of flushing.

Reference will now be made in detail to exemplary aspects of the present invention that are illustrated in the accompanying drawing. Wherever possible, the same reference numbers will be used throughout the drawing to refer to the same or like parts.

Figure 2:
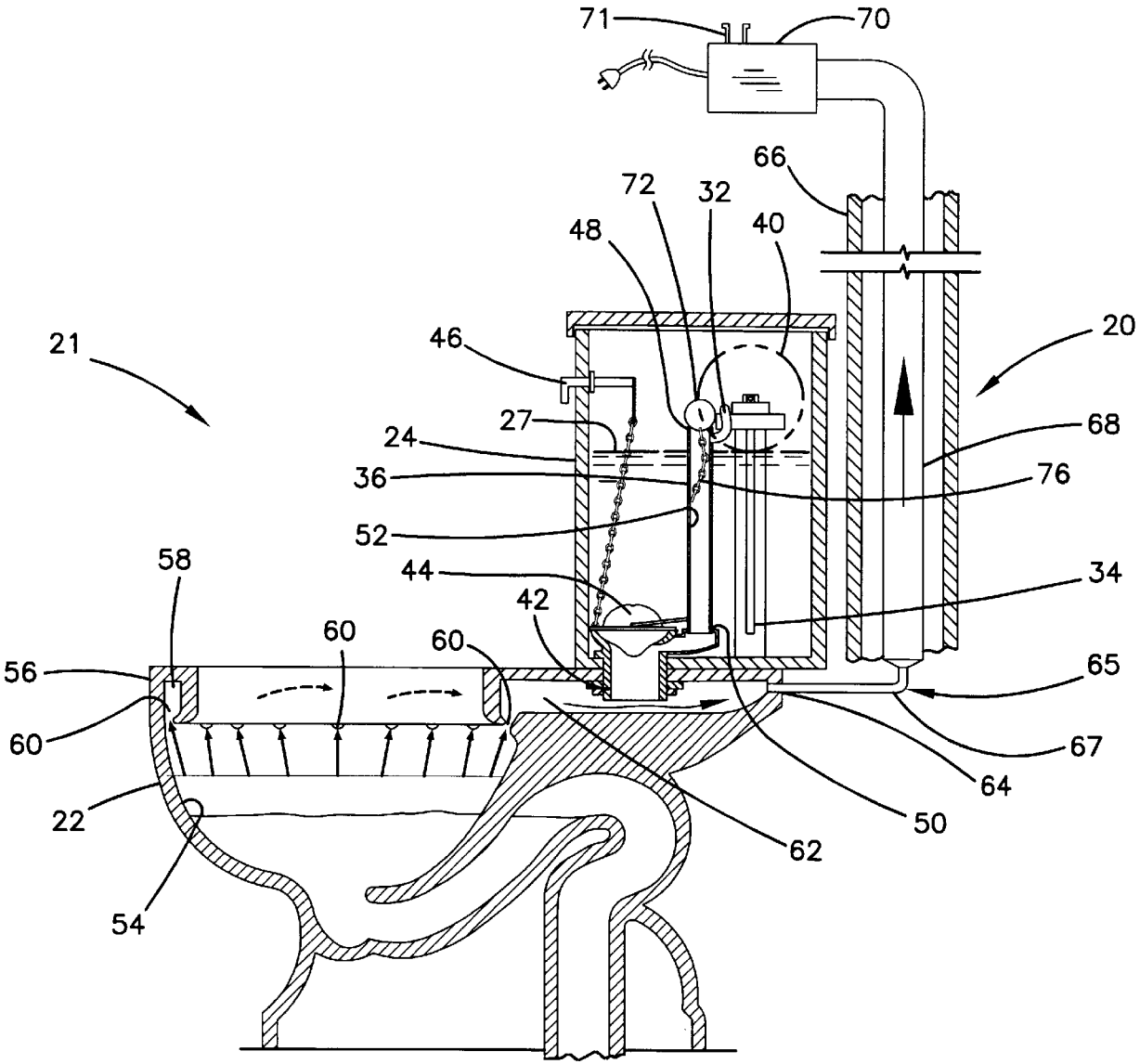
FIG. 2 is another schematic cross-sectional view of the toilet of FIG. 1, the toilet is shown with the ventilation system drawing air from the bowl.
Figure 3:
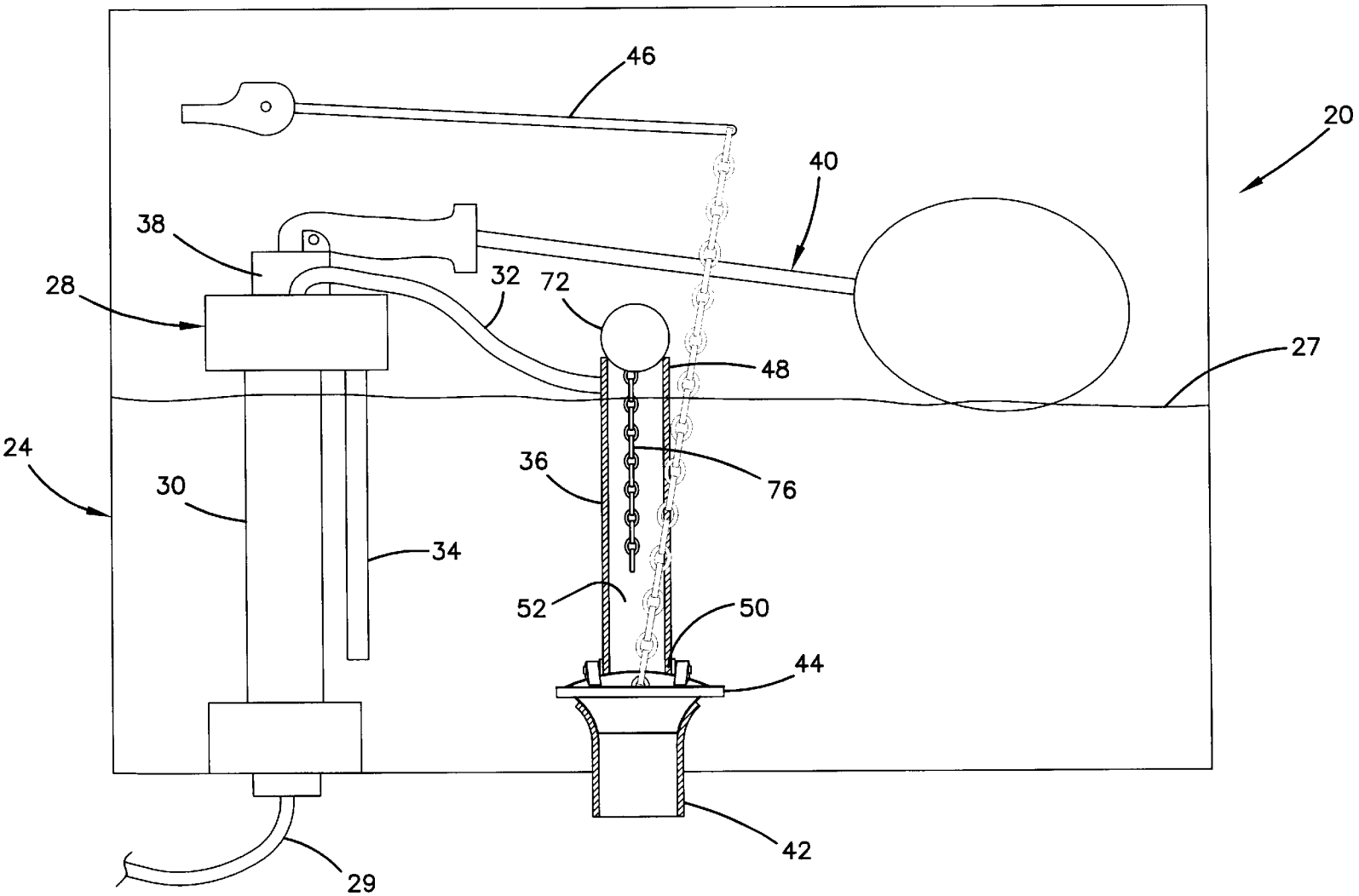
FIG. 3 is a schematic front cross-sectional view of the tank of the toilet of FIG. 2.

FIGS. 1–3 illustrate a toilet ventilation system 20 constructed in accordance with the principles of the present invention. The toilet ventilation system 20 includes a toilet 21 having a base 22 (i.e., a stool) and a tank 24. The tank 24 is preferably mounted to the base 22 by conventional techniques.

The tank 24 defines a reservoir for holding water. As best shown in FIG. 3, a conventional water supply arrangement 28 is mounted within the tank 24. The water supply arrangement 28 includes an inlet line 30 connected to a source of pressurized water 29 such as a conventional municipal water supply line. The water supply arrangement 28 also includes first and second water supply tubes 32 and 34 that receive water from the inlet line 30. The first water supply tube 32 directs water from the inlet line 30 to a tank overflow tube 36. The second water supply tube 34 functions to fill the tank 24 with water after the toilet 21 has been flushed.

The water supply arrangement 28 includes a valve 38 for controlling water flow between the inlet line 30 and the first and second water supply tubes 32 and 34. A conventional float arrangement 40 is used to open and close the valve 38. For example, when the toilet 21 is flushed, the water level in the tank 24 drops causing the float arrangement 40 to also drop. When the float arrangement 40 drops, the valve 38 is caused to open flow between the inlet line 30 and the first and second water supply tubes 32 and 34. With the valve 38 open, the second water supply tube 34 refills the tank 24 causing that the water level in the tank 24 to rise. As the water level in the tank 24 rises, the float 40 also rises. When the float 40 reaches a predetermined level 27 (shown in FIG. 2), the valve 38 closes and flow is stopped between the inlet line 30 and the first and second water supply tubes 32 and 34.

Referring back to FIGS. 1 and 2, a discharge pipe 42 is used to discharge water through the bottom of the tank 24 when the toilet 21 is flushed. The discharge pipe 42 is opened and closed by a conventional flapper or plunger valve 44. A conventional handle and chain arrangement 46 is used to open and close the plunger valve 44. To flush the toilet 21, the handle is pressed downward causing the chain to lift the plunger valve 44 to an open position (shown in FIG. 1). With the plunger valve 44 in the open position, the water in the tank 24 is discharged through the discharge pipe 42. After the water has been discharged through the discharge pipe 42, the plunger valve 44 moves to a closed position (shown in FIG. 2) such that the tank 24 can be refilled with water.

The tank overflow tube 36 includes a top end 48 and a bottom end 50. The top end 48 is positioned above the predetermined water level 27 of the tank 24. The predetermined water level 27 is coextensive with a desired maximum water level height of the tank 24. The bottom end 50 of the tank overflow tube 36 is connected to the discharge pipe 42 at a location below the plunger valve 44. The tank overflow tube 36 defines a passageway 52 that extends from the top end 48 to the bottom end 50. The passageway 52 is in fluid communication with the interior of the discharge pipe 42 and bypasses the plunger valve 44. In this manner, the passageway 52 is open regardless of whether the plunger valve 44 is in the open or closed position.

The base 22 of the toilet ventilation system 20 includes a basin or bowl 54. The bowl 54 includes a circumferencial rim 56 defining a circumferencial rim chamber 58. The bowl 54 defines a plurality of ports 60 in fluid communication with the rim chamber 58. The base 22 also defines an intermediate chamber 62 providing fluid communication between the discharge pipe 42 and the rim chamber 58. The intermediate chamber 62 and the rim chamber 58 cooperate to form an interior passageway that provides fluid communication between the discharge pipe 42 and the ports 60.

The base 22 also defines a ventilation port 64 adapted for connection to a ventilation line 65. Preferably, the ventilation port 64 is located at an inconspicuous position such as a back region of the base 22. The ventilation port 64 is preferably in fluid communication with the intermediate chamber 62. It will be appreciated that the ventilation port 64 can be formed in the base 22 at the time the toilet is manufactured. Alternatively, existing toilets can be retrofitted by drilling the ventilation port 64 and then mounting a water tight fitting within the port 64. Such a fitting allows the ventilation line 65 to be easily connected to the ventilation port 64.

As shown in FIGS. 1 and 2, the ventilation line 65 extends from the ventilation port 64 through a wall 66 positioned behind the toilet 21. Once inside the wall 66, the ventilation line 65 preferably extends in an upward direction. The upward extending portion of the ventilation line 65 can include an increased diameter portion 68. The increased diameter portion 68 reduces the velocity of the air being drawn through the ventilation line 65 to prevent water from following the air stream up the ventilation line 65. In one non-limiting embodiment, the ventilation line 65 includes a substantially horizontal reduced diameter portion 67 having a diameter of around 1 and 1¼ inch, and the increased diameter portion 68 can have a diameter of about 3 inches. The ventilation line 65 is preferably connected to a source of vacuum 70 such as a fan or blower having a discharge port 71 typically in fluid communication with a vent.

The tank overflow tube 36 of the toilet ventilation system 20 provides two primary functions. First, the tank overflow tube 36 prevents the tank 24 from overflowing. For example, should the valve 38 malfunction and continue to supply water to the tank 24 even after the water level reaches the desired maximum fill level 27, the water level within the tank will rise until it reaches the top end 48 of the overflow tube 36. When the water level reaches the top end 48 of the overflow tube 36, the water flows into the passageway 52 of the overflow tube 36. From the passageway 52, the water exits the tank through the discharge pipe 42 and flows into the intermediate chamber 62. From the intermediate chamber 62, the water flows into the rim chamber 58 and is discharged into the bowl 54 through the ports 60.

The overflow tube 36 also functions to refill the bowl 54 after the toilet 21 has been flushed. For example, after the toilet 21 has been flushed, the first water supply tube 32 conveys water into the passageway 52 of the overflow tube 36. The water from the first water supply tube 32 flows downward through the passageway 52 and exits the tank 24 through the discharge pipe 42. From the discharge pipe 42, the water flows through the intermediate chamber 62 into the rim chamber 58. From the rim chamber 58, the water flows through the ports 60 into the interior of the bowl 54. In this manner, the water provided by the first water supply tube 32 refills the bowl 54 after the toilet has been flushed. Water flow through the first water supply tube 32 stops when the water level in the tank reaches the desired maximum fill level 27.

Referring again to FIG. 1, the first water supply tube 32 preferably extends from the valve 38 to the tank overflow tube 36. The first water supply tube 32 is preferably connected to the tank overflow tube 36 at a location between the top end 48 of the overflow tube 36 and the desired maximum water level 27 of the tank 24.

The tank overflow tube 36 includes a valve structure that allows water from the tank 24 to flow downward through the overflow tube 36, but prevents air from the tank 24 from being drawn downward through the overflow tube 36. For example, as shown in FIG. 1, the valve structure is shown as a float ball 72 positioned at the top end 48 of the overflow tube 36. When the water level in the tank 24 rises above the top end 48 of the overflow tube 36, the float ball 72 (which is less dense than water) floats upward to allow water to flow into the passageway 52 of the overflow tube 36. A chain 76 prevents the float ball 72 from floating away from the overflow tube 36.

In use of the toilet ventilation system 20, the ventilation line 65 functions to evacuate or withdraw air from the interior of the bowl 54 through the ports 60 as shown in FIG. 2. For example, when the plunger valve 44 is closed and no water is in the rim chamber 58, the vacuum source 70 can be used to draw air from the toilet bowl 54 through the ventilation line 65. Specifically, air is drawn from the bowl 54 into the rim chamber 58 through the ports 60. From the rim chamber 58, the air is drawn into the intermediate chamber 62 and exits the base 22 through the ventilation port 64. From the ventilation port 64, the air is drawn upward through the ventilation line 65 by the vacuum 70 and is discharged through the vacuum discharge port 71 to a vent.

While air is being drawn from the bowl 54, the float ball 72 prevents air from being drawn from the tank 24 through the overflow tube 36. For example, the vacuum provided by the source of vacuum 70 causes the float ball 72 to be drawn against the top end 48 of the overflow tube 36 thereby providing a seal. The seal is significant because it prevents the vacuum source 70 from evacuating clean air from the tank 24. Instead, the air is evacuated strictly from the base 22. By minimizing the amount of air drawn by the ventilation line 65, smaller, less powerful sources of vacuum 70 can be used. By using smaller fans, operating efficiency is improved and noise levels are reduced.

It will be appreciated that when the toilet is in the process of being flushed as shown in FIG. 1, no air will be ventilated through the ports 60 of the toilet bowl 54. Instead, when the toilet is flushed, water flows from the tank 24 through the discharge pipe 42 and into the intermediate chamber 62.

From the intermediate chamber 62, the water flows into the rim chamber 58 and enters the interior of the bowl 54 through the ports 60. While the rim chamber 58 and the intermediate chamber 62 are filled with water, air cannot be drawn through the ports 60. After the toilet has been flushed, the intermediate chamber 62 and the rim chamber 58 remain filled until the bowl 54 is refilled with water supplied by the first water supply tube 32.

Once the tank 24 and the bowl 54 have been re-filled, the valve 38 of the water supply and float level arrangement 28 closes flow to the first and second water supply tubes 32 and 34. Hence, no additional water is provided to the intermediate and rim chambers 62 and 58 and the remaining water within the intermediate and rim chambers 62 and 58 drains into the bowl 54 through the ports 60. After the water drains from the rim and intermediate chambers 58 and 62 into the bowl 54, the toilet ventilation system is again operative to draw air directly from the bowl 54 through the ports 60 as shown in FIG. 2.

With regard to the foregoing description, it is to be understood that changes may be made in detail, especially in matters of the construction materials employed and the shape, size and arrangement of the parts without departing from the scope of the present invention. For example, while a float ball is shown for sealing the overflow tube, it will be appreciated that any valve type structure that allows water to flow in one direction through a tube, but prevents air from flowing in the same direction through the tube, can be utilized. It is intended that the specification and depicted embodiment be considered exemplary only, with a true scope and spirit of the invention being indicated by the broad meaning of the following claims.

I claim:

1. A toilet ventilation system comprising:

a one-piece toilet stool including a toilet bowl having a rim, the toilet bowl being located at a front of the stool and the rim including an upwardly facing top surface that encircles an interior bowl portion of the toilet bowl;

the toilet bowl defining a rim chamber extending generally along the rim of the toilet bowl, the toilet bowl also defining a plurality of ports in fluid communication with the rim chamber for conveying water from the rim chamber to the interior bowl portion of the toilet bowl;

a tank mounted on top of the toilet stool for holding water;

the toilet stool defining an intermediate chamber for conveying water from the tank to the rim chamber;

a discharge pipe for directing water from the tank to the intermediate chamber, and a valve for opening and closing the discharge pipe, the discharge pipe extending through a top wall of the toilet stool and a bottom wall of the tank;

an overflow tube mounted in the tank, the overflow tube being in fluid communication with the intermediate chamber, fluid communication between the overflow tube and the intermediate chamber being provided by the discharge pipe, the overflow tube connecting with the discharge pipe at a location below the valve that opens and closes the discharge pipe;

the toilet stool including a rear wall that defines a rear portion of the intermediate chamber, the rear wall defining a rear ventilation port that extends through the rear wall from the intermediate chamber to an exterior of the stool, the ventilation port being adapted for connection to a ventilation line, and the ventilation port being located at a lower elevation than the top surface of the rim; and a valve structure that allows water to flow from the tank through the overflow tube, but prevents air from being drawn from the tank through the overflow tube.

2. The toilet ventilation system of claim 1, wherein the valve structure includes a float ball positioned at a top of the overflow tube.

3. The toilet ventilation system of claim 2, further comprising a water supply conduit connected to the overflow tube at a location below the valve structure.

4. The toilet ventilation system of claim 1, further comprising the ventilation line, wherein the ventilation line is connected to the ventilation port, and extends through a wall positioned behind the toilet structure.

5. The toilet ventilation system of claim 4, wherein the ventilation line includes an upward extending portion positioned behind the wall, the upward extending portion including an increased diameter portion for reducing an air flow velocity in the ventilation line.

6. The toilet ventilation system of claim 5, further comprising a fan for drawing air though the ventilation line.

* * * * *